US008360147B2

(12) United States Patent
Ford et al.

(10) Patent No.: US 8,360,147 B2
(45) Date of Patent: Jan. 29, 2013

(54) LOCATION-AND-ROTATION FEEDBACK TOOL FOR SUBSEA WELLHEADS AND METHOD OF OPERATING SAME

(75) Inventors: David L. Ford, Houston, TX (US); Johnny E. Jurena, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 564 days.

(21) Appl. No.: 12/415,661

(22) Filed: Mar. 31, 2009

(65) Prior Publication Data

US 2010/0243244 A1 Sep. 30, 2010

(51) Int. Cl.
*E21B 47/09* (2012.01)

(52) U.S. Cl. ..... 166/255.1; 166/242.3; 166/341

(58) Field of Classification Search ..... 166/336, 166/339, 341, 255.1, 348, 368, 382, 250.07, 166/255.2, 113, 66
See application file for complete search history.

(56) References Cited

U.S. PATENT DOCUMENTS

| | | | | |
|---|---|---|---|---|
| 3,336,976 | A * | 8/1967 | Word, Jr. | 166/336 |
| 4,353,420 | A * | 10/1982 | Miller | 166/382 |
| 4,836,288 | A * | 6/1989 | Wester | 166/348 |
| 4,862,426 | A * | 8/1989 | Cassity et al. | 367/81 |
| 5,450,905 | A * | 9/1995 | Brammer et al. | 166/348 |
| 6,253,854 | B1 | 7/2001 | Fenton | |
| 6,478,087 | B2 | 11/2002 | Allen | |
| 8,033,756 | B2 * | 10/2011 | Adamson | 405/228 |
| 2007/0272415 | A1 * | 11/2007 | Ratliff et al. | 166/368 |

* cited by examiner

*Primary Examiner* — William P Neuder
*Assistant Examiner* — Richard Alker
(74) *Attorney, Agent, or Firm* — Bracewell & Giuliani LLP

(57) ABSTRACT

A location-and-rotation feedback tool that provides accurate feedback of the location and orientation of a well component during running operations in wells. The feedback tool device is adapted to be secured on a tool stem above a running tool and comprises a body, a circumferentially extending groove, and a hole in the groove that vents to the bore of a blowout preventer. The circumferential groove aligns with a fluid line port in the blowout preventer to provide location feedback via a fluid line pressure. The hole aligns with the fluid line port in the blowout preventer to provide rotation feedback via fluid line pressure.

14 Claims, 4 Drawing Sheets

Fig. 4
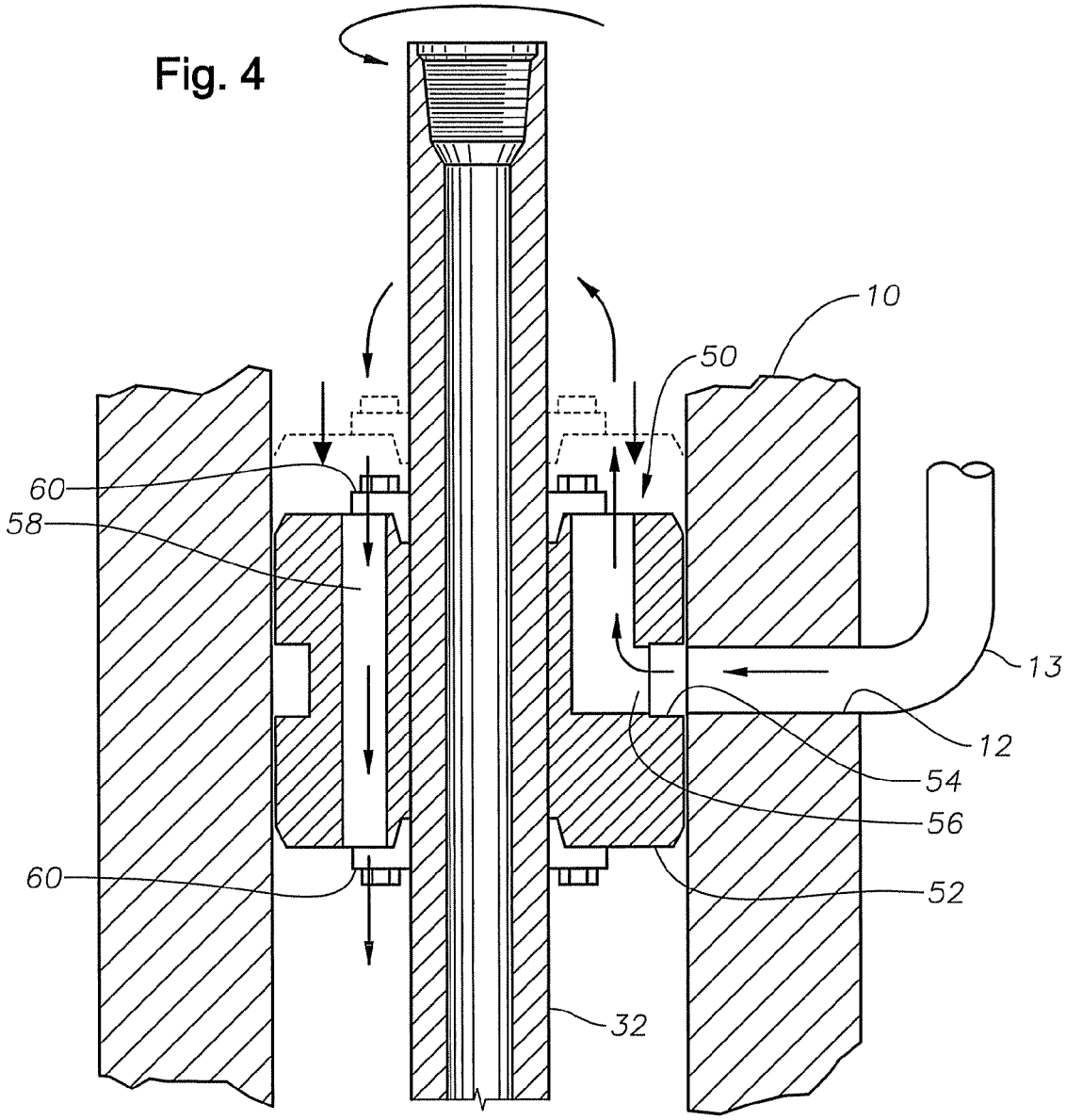
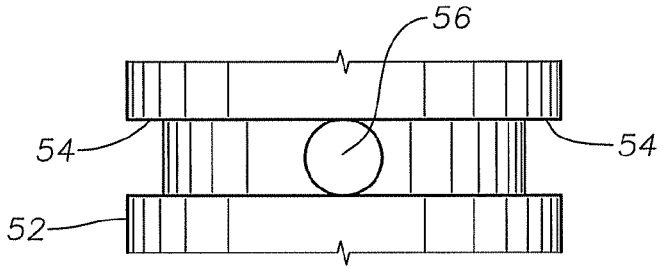
Fig. 5

LOCATION-AND-ROTATION FEEDBACK TOOL FOR SUBSEA WELLHEADS AND METHOD OF OPERATING SAME

BACKGROUND

1. Field of Invention

This invention relates in general to well component positioning, and in particular to a device that provides an operator with the location-and-rotation of a tool during wellhead operation.

2. Description of Related Art

The operation of equipment in remote and inaccessible locations, such as subsea wellheads, is difficult because there is no information available as to the condition or the occurrence of an event in such remote location. It is thus difficult to determine if a particular subsea wellhead operation has been successful. Wellhead operations may include landing a casing hanger on the housing seat, properly locating an annulus seal, properly positioning a tool or component at a particular level, or rotating a tool or component to a particular orientation within the wellhead.

The operation and placement of well components in a wellhead housing bore, riser bore, or blowout preventer (BOP) stack is critical in oil and gas drilling operations, especially in offshore operations where down time is very expensive. Thus a variety of approaches have been used in an attempt to provide reliable location-and-rotation of well components. Hard landing a casing hanger can be used as an indicator of location but it can be a false indicator if the hanger gets snagged on debris or other obstruction in the well bore.

An index line has also been used in conjunction with hard landing. However, the index line becomes inaccurate as longer lines are used in deeper waters, which can lead to costly errors in location when setting a tool. Another approach calls for the use of radioactive material to provide a location signal. Overpull can also be used as a location indicator but is not viable for all types of tools.

Acoustic or ferrous metal detectors, as well as magnetic detection units have also been used as location tools. U.S. Pat. No. 4,314,365 shows a system for transmitting and detecting acoustic signals along a drill pipe string, and U.S. Pat. No. 4,862,426 discloses an apparatus that uses acoustic or ferrous metal detectors to determine if certain operations such as landing a casing hanger are completed. German Utility Model Application No. 110 08 413.5 shows a system for detecting tool joints using magnetic detection units in a planar arrangement.

Moreover, a method and apparatus for sensing the profile and position of a well component in a well bore is disclosed in U.S. Pat. No. 6,478,087. The apparatus uses acoustic, ultrasonic, or optical sensors to sense well components and then transmits the information to a display at the surface.

Improvements that make the identification of the location and the rotation of well bore tools and components more reliable, less complicated, less costly, and more accessible are desired. The techniques described below address one or more of the problems described above.

SUMMARY OF INVENTION

A system and method for providing a reliable indicator of a well component's location and orientation in a subsea wellhead or well bore is presented. In the illustrated embodiment, a location-and-rotation feedback tool is presented that provides feedback to a surface location via fluid pressure in a choke-and-kill line. The pressure feedback location enables the feedback tool to be aligned with a choke-and-kill line port. The distance from the choke-and-kill line port in the BOP to points within the BOP, subsea wellhead, or wellbore is known. In addition, the distance from the component to the feedback tool is known, and may be adjusted to obtain a desired distance. Thus, the location of the component in the BOP, subsea wellhead, or wellbore may be established by aligning the feedback tool with the choke-and-kill line port. In addition, the pressure feedback enables the rotation of the feedback tool relative to the choke-and-kill line port to be established. The location-and-rotation feedback tool may be used in many operations, such as landing a casing hanger in a subsea wellhead seat, positioning and setting an annular seal between a subsea wellhead and a casing hanger, or positioning a well component such as a test plug or tool joint at a particular level, or orientation, in a wellbore, wellhead, or BOP stack.

The illustrated technique utilizes a flow of fluid from the choke-and-kill line into the BOP to establish when the feedback tool is aligned with the choke-and-kill line port of the BOP. The location feedback provided to the surface is in the form of a pressure profile in the fluid within the choke-and-kill line as the feedback tool is moved vertically in the well. The rotation feedback also is provided to the surface in the form of a pressure profile obtained from the fluid in the choke-and-kill line. However, the pressure profile is obtained as the feedback tool is rotated in the BOP in reference to the choke-and-kill line port.

BRIEF DESCRIPTION OF DRAWINGS

Some of the features and benefits of the present invention having been stated, others will become apparent as the description proceeds when taken in conjunction with the accompanying drawings, in which:

FIG. 4 is an enlarged sectional view of a passage of the location-and-rotation feedback tool aligned with the control line port of the BOP, in accordance with a preferred embodiment of the invention.

FIG. 5 is an elevation view of groove and passage of the location-and-rotation feedback tool, in accordance with a preferred embodiment of the invention.

DETAILED DESCRIPTION OF INVENTION

Figure 1:
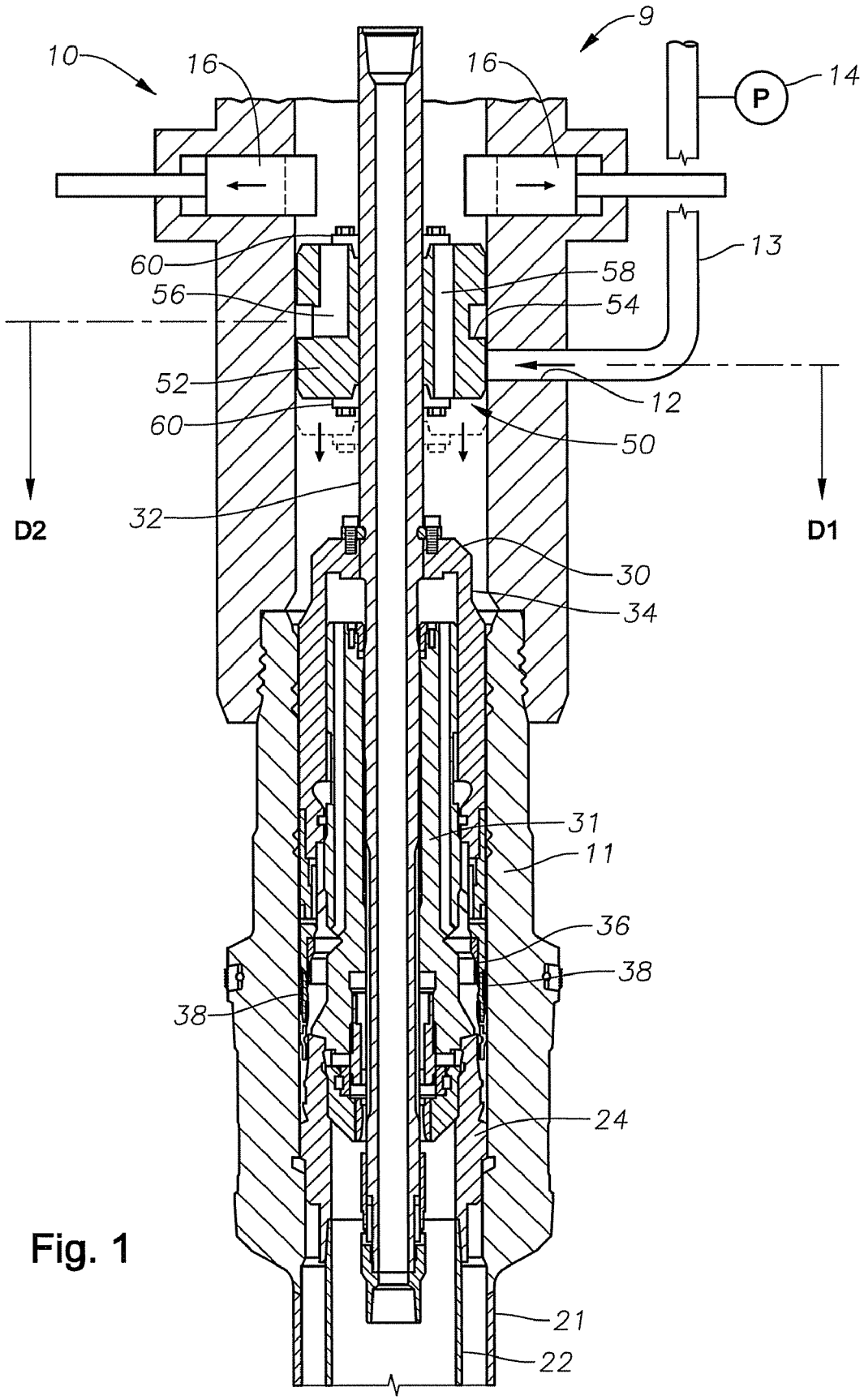
FIG. 1 is a view of the overall assembly showing the feedback tool within a BOP and attached to the tool stem of a running tool, in accordance with a preferred embodiment of the invention.

Referring generally to FIG. 1, a subsea wellhead assembly 9 is presented. The illustrated embodiment of the subsea wellhead assembly 9 comprises a blowout preventer ("BOP") 10 stack and a subsea wellhead housing 11. The BOP 10 has a choke-and-kill line port 12 that is coupled to a choke-and-kill line 13 that is coupled to the surface. The choke-and-kill line port 12 serves as a reference point from which a distance, D1, to a location within the subsea wellhead 11 may be determined. In this embodiment, the choke-and-kill line 13 has a pressure reading device 14 that may be read on the surface. One set of rams 16 is shown in the BOP 10 for reference. However, the BOP 10 may have additional rams. In addition, the subsea wellhead housing 11 supports a first set of well casing 21 that extends into the wellbore. A wellhead casing hanger 24 is landed within the wellhead housing 11 to support additional casing 22 below.

In the illustrated embodiment, a running tool 30 is used to install a casing hanger 24 within the subsea wellhead housing 11. The running tool 30 is connected to a tool stem 32 to enable movement of the running tool 30 and casing hanger 24 through the bore of the BOP 10 into housing 11.

Running tool 30 is conventional and has a body 31 that releasably secures, to casing hanger 24. Running tool 30 has a sleeve 34 with an energizing ring 36 on its lower end. Sleeve 34 moves relative to body 31 from the upper position shown in FIG. 1 to a lower position shown in FIG. 3. The engagement between tool body 31 and sleeve 34 may be threaded so that rotation of stem 32 causes sleeve 34 to move downward or upward. Alternatively, the movement of sleeve 34 could be hydraulically pressurized as shown. The hydraulic pressure may be applied by closing the BOP around stem 32 and pumping fluid into the bore of the BOP through choke and kill line 12. The pressure acts on a seal (not shown) on the outer diameter of sleeve 34, that engages the bore of wellhead housing 11. The hydraulic pressure causes sleeve 34 and energizing ring 36 to move downward. The hydraulic pressure may also be applied to the running tool 30 via the tool stem 32. Energizing ring 36 is employed to set an annular seal 38 between the wellhead housing 11 and the wellhead casing hanger 24. Initially seal 38 will be carried by energizing ring 36, as shown in FIG. 1, before being set.

A location-and-rotation feedback tool 50 is connected to the tool stem 32 above the running tool 30 to enable a wellhead housing component, such as the casing hanger 24, to be positioned at a desired location within the subsea wellhead housing 24. The location-and-rotation feedback tool 50 is positioned on the tool stem 32 so that the distance, D2, between the wellhead component and the feedback tool 50 places the wellhead component at the desired distance, D1, from the choke-and-kill line port 12 when the feedback tool 50 is aligned with the choke-and-kill line port 12. In the illustrated embodiment, the location-and-rotation feedback tool 50 is positioned on the tool stem 32 so that the feedback tool 50 will be positioned opposite the choke-and-kill line port 12 when the casing hanger 24 has landed on the load shoulder in the wellhead housing 11. As will be discussed in more detail below, the position of the feedback tool 50 relative to the choke-and-kill port 12 will affect fluid pressure in the choke-and-kill line 13 that may be read on the pressure reading device 14. If the casing hanger 24 is landed at the correct location, the feedback tool 50 will be located opposite the choke-and-kill port 12 and an expected pressure may be read on the pressure reading device 14. However, if the casing hanger 24 is landed at an incorrect location, the feedback tool 50 will not be located opposite the choke-and-kill port 12 and the expected pressure will not be read on the pressure reading device 14.

Figure 2:
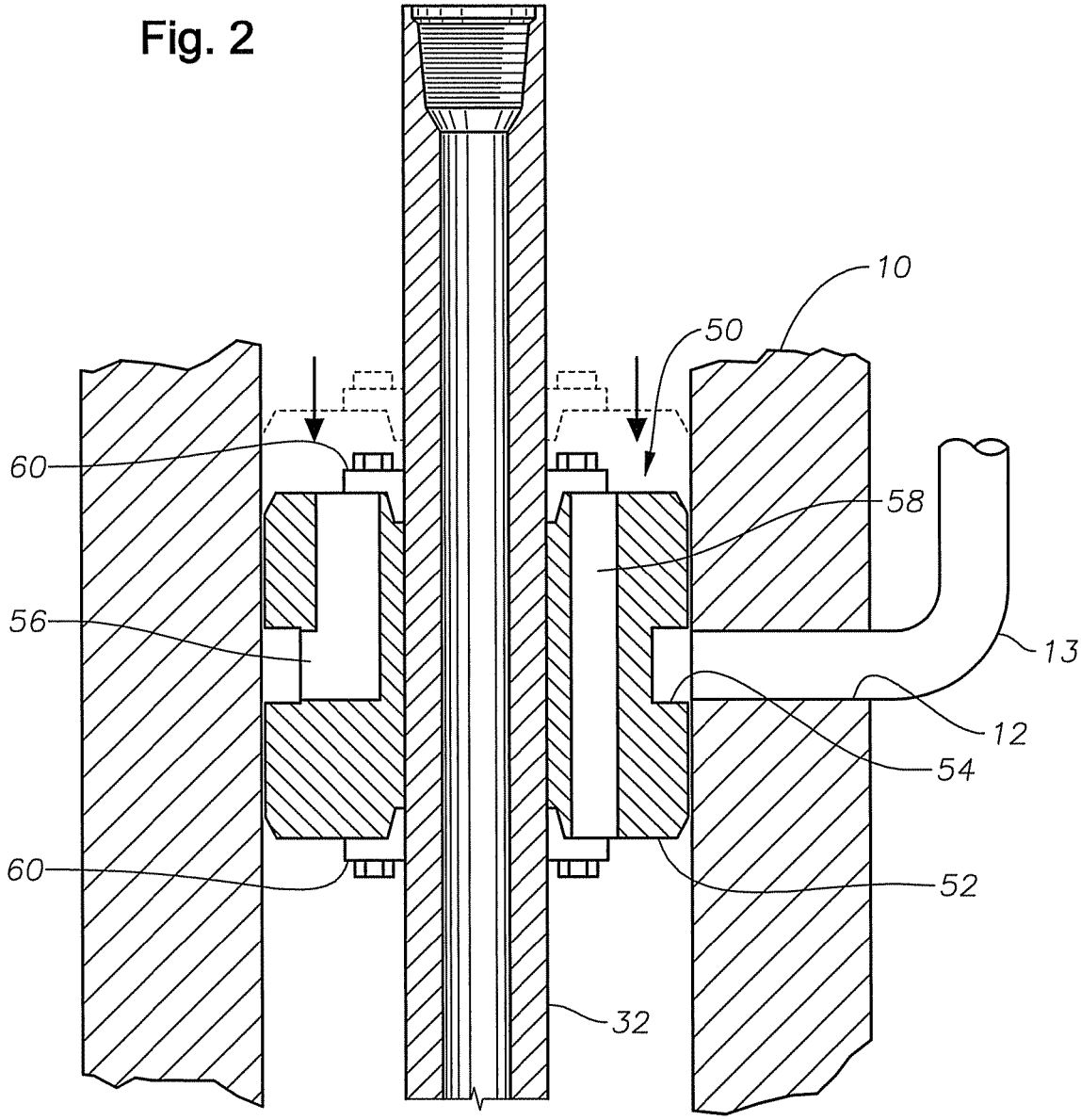
FIG. 2 is an enlarged sectional view of a groove of the location-and-rotation feedback tool aligned with the control line port of the BOP, in accordance with a preferred embodiment of the invention.

Referring to FIG. 2, the feedback tool 50 is shown in more detail within the BOP 10 stack. The illustrated embodiment of the feedback tool body 52 is a metallic cylinder and has a circumferentially extending groove 54 located approximately at the midpoint of the axial length of the feedback tool 50. However, another material may be used. The groove 54 allows fluid to flow from the choke-and-kill line port 12 into the feedback tool body 52 when the two are aligned during a running operation.

In this embodiment, an outlet passage 56 extending from the upper end of the feedback tool body 52 to about the central part of the body 52 communicates with the circumferential groove 54 to allow fluid entering the groove 54 to flow up into the bore of the BOP 10 above the feedback tool 50. A plurality of through passages 58 vertically traverse the body 52 of the feedback tool 50 to allow flow-by during operations such as tripping and cementing. Passages 58 extend from the upper to the lower end of feedback tool 50, communicating fluid through the feedback tool 50.

The feedback tool 50 is preferably locked onto the tool stem 32 with two split gland locks 60 that are typically referred to as Morse taper locks. One set of locks 60 is located at the top and another set of locks 60 is located at the bottom of the tool 50 to lock onto the tool stem 32 by friction caused by the interference between the tapered locks 60 and wedges machined into the tool body 52 at the tool 50 bore.

Figure 3:
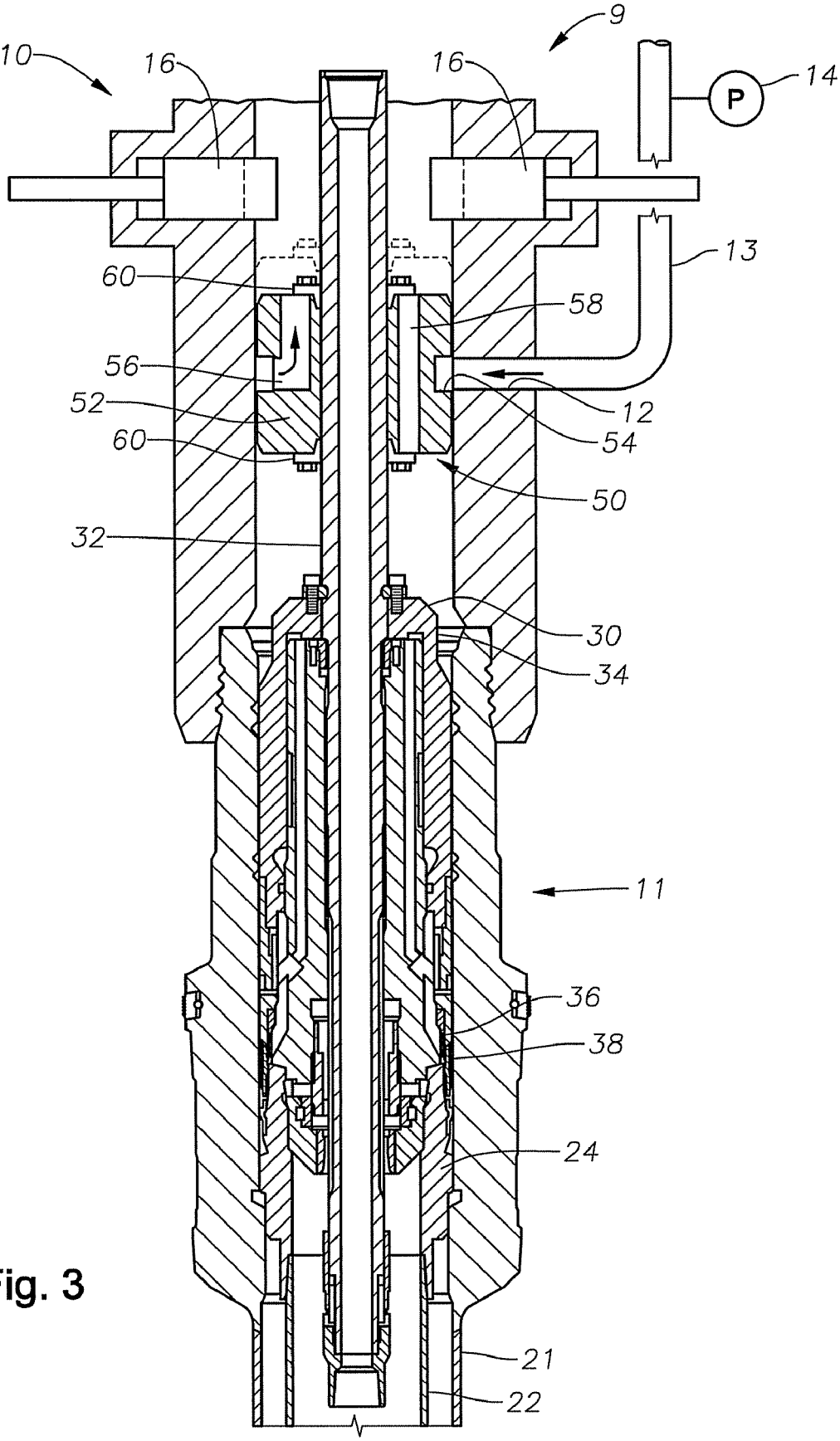
FIG. 3 is a sectional view of the location-and-rotation feedback tool in alignment with the choke/kill line port of the BOP as an annular seal is set with a running tool, in accordance with a preferred embodiment of the invention.

In a running operation as shown in FIG. 3, the tool stem 32 is used to lower the running tool 30 and the feedback tool 50 down through bore of the BOP 10 and the wellhead housing 11. In this example, the running tool 30 will run casing 22, land casing hanger 24, and then set annulus seal 38 between the wellhead housing 11 and the casing hanger 24. As the feedback tool 50 is lowered into the BOP 10, the body 52 of the feedback tool 50 will block flow from the choke-and-kill line port 12, causing an increase in fluid pressure in the choke-and-kill line 13. This increase in pressure may be observed at the pressure reading device 14. As the tool stem 32 is lowered further, the circumferential groove 54 in the feedback tool body 52 will align with the choke-and-kill line port 12, causing a pressure drop in the choke-and-kill line 13. This will also be reflected by the pressure reading device 14. The pressure changes will provide feedback that the feedback tool 50, and, therefore, the casing hanger 24, are located at the correct location. After casing hanger 24 lands and its position is verified using the location-and-rotation feedback tool 50, the operator pumps cement down casing 22, which flows back up the annulus between casing 21 and casing 22. If the position of casing hanger 24 is not verified by the feedback tool 50, the running tool 30 may be raised and another attempt may be made to land the casing hanger 24 at the correct landing. Seal 38 will then be in an upper position along with energizing ring 36 while running and cementing casing 22.

Running tool 30 is then actuated to move seal 38 from the upper position down to the lower position. The tool stem 32 and feedback tool 50 may be rotated to actuate running tool 30 to position the seal 38 in a seal pocket of the casing hanger 24. The distance the energizing ring 36 and annulus seal 38 must travel downward relative to running tool body 31 to set is known. The correct locking location on the tool stem 32 for the feedback tool 50 is thus previously determined from this known distance and accurately calibrates the feedback tool 50 to provide confirmation of the seal 38 setting as explained below.

During cementing, feedback tool 50 may be spaced a short distance above choke-and-kill line port 12 or it may be partially blocking port 12 as shown in FIG. 1. Afterward, the operator begins to stroke energizing ring 36 downward to set seal 38. In this embodiment, the operator does this by closing the BOP 10 around the stem 32 and pumping fluid through choke and kill line 12. Initially the fluid will flow up passage 58. Small clearances around feedback tool 50 and the bore of wellhead housing 11 allow fluid pressure from port 12 to act on sleeve 34.

The pressure causes sleeve 34 and energizing ring to move down inside wellhead housing 11 stack relative to the tool body 31. Feedback tool 50 also moves downward inside BOP 10. As the feedback tool 50 moves down inside the BOP 10 stack, the pressure in the choke-and-kill line 12 will decrease when the circumferential groove 54 in the feedback tool body 52 aligns with the choke-and-kill line 12. The fluid from the choke-and-kill line 12 now flows up passage 56. The pressure drop will provide feedback, via the lower reading registered by the pressure reading device 14, confirming that the annulus seal 38 landed and was set at the correct location within the wellhead housing 11. In this example, the seal 38 is set by closing the annular space in the well and pressuring up the BOP 10, causing energizing ring 36 to set the seal 38. After seal 38 is set, the operator stops pumping through choke-and-kill line 12, releases the engagement of BOP 10 around stem 32, and lifts stem 32. The operator releases body 31 from casing hanger 24 and retrieves running tool 30.

Referring generally to FIGS. 4 and 5, feedback as to the orientation of a well component can be obtained by rotating the tool stem 32 and thereby the feedback tool 50. As the feedback tool 50 is rotated, the outlet passage 56 extending upward from the groove 54 will periodically align with the choke-and-kill line port 12. The fluid now has a more direct path to outlet passage 56 since it does not need to flow around groove 54. This results in a further decrease in pressure that is observed via the pressure reading device 14. This reading provides feedback as to the orientation of a well component and can provide feedback as to the number of clockwise or counter-clockwise turns a component makes. This is useful for running operations requiring confirmation of the number of turns required to engage or disengage tool mechanisms.

In another embodiment, a plurality of holes can be cut into the groove. In a further additional embodiment, location and feedback tool can be used to properly orient a tool or component at a particular level, or rotate a tool or component a required number of times during running operations.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for obtaining feedback of the location of a well component comprising:

a wellhead assembly with a bore;

port leading through the wellhead assembly into the bore to provide a path for a fluid to flow into the bore from an external location; and a tool for performing an operation in a well comprising;

an elongated stem, a body circumscribing the stem, a feedback member mounted to the stem, the tool moveable from a position so that an outer surface of the feedback member blocks the port, and a passage in the feedback member adapted to provide a path for fluid to flow from the port through the feedback member, wherein the passage in the feedback member has an inlet in the form of a circumferential groove on the exterior of the feedback member; and a pressure reading device adapted to establish pressure of the fluid, so that when the tool is moved to register the passage with the port, a pressure measured with the pressure reading device is less than a pressure measured with the pressure reading device when the outer surface of the feedback member blocks the port.

2. The apparatus of claim 1, wherein the wellhead assembly is a blowout preventer.

3. The apparatus of claim 1, wherein the port leading into the bore is coupled to a choke-and-kill line.

4. The apparatus of claim 3, wherein the pressure reading device is coupled to the choke-and-kill line.

5. The apparatus of claim 1, wherein the tool for performing an operation in the well is a running tool for running casing, landing a casing hanger, and setting an annular seal.

6. The apparatus of claim 1, wherein the feedback member has a cylindrical body with an outer diameter smaller than the inside diameter of the wellhead assembly.

7. The apparatus of claim 1, wherein the feedback member is selectively secured to a tool stem.

8. The apparatus of claim 1, wherein the passage in the feedback member has an outlet that vents to the bore in the wellhead assembly and communicates with an inlet on the passage.

9. The apparatus of claim 1, wherein the feedback member has a plurality of passages traversing the body of the feedback member vertically to allow fluid to flow through the body of the feedback member.

10. An apparatus for performing an operation in a well comprising:

a running tool selectively insertable into a well casing and having a stem and a body circumscribing the stem;

an annular feedback member with a cylindrical exterior mounted around the stem and above the body;

an outlet passage in the feedback member extending between an outer surface of the feedback member and an upper end of the feedback member distal from the body;

a vertical passage axially formed through a sidewall of the feedback member, and wherein the tool is moveable from a position where the outer surface of the feedback member is adjacent an exit of a fluid line that communicates to surface to a position where the exit of the fluid line registers with the outlet passage.

11. The apparatus of claim 10, wherein a pressure measured in the fluid line when the outer surface of the feedback member adjacent an exit of a fluid line is greater than a pressure measured in the fluid line when the exit of the fluid line registers with the outlet passage.

12. A method for performing an operation in a well comprising:

coupling a feedback member to a tool;

the feedback member having a cylindrical exterior for close reception with a bore of a wellhead member to enable the cylindrical exterior to block a port extending through the wellhead member into the bore, and the feedback member having a passage therein with an inlet facing the wellhead member and an outlet leading into the bore of the wellhead member to provide a path for fluid to flow from the port in the wellhead member to the bore when the inlet is aligned with the port;

lowering the tool into the bore of the wellhead member;

producing a flow of fluid into the bore through the port of the wellhead member;

identifying an increase in pressure of the fluid;

observing a reduction in pressure as the passage on the feedback member aligns with the port to confirm the location of a well component placed in the well during the well operation; and wherein rotation of the well component placed in the well during the well operation is confirmed by rotating the feedback member and observing a further reduction in pressure as the outlet of the passage on the cylindrical exterior of the feedback member aligns with the port.

13. A tool for locating a component in reference to a wellhead assembly having a bore, comprising:

an elongated tool stem having an upper end selectively coupled with a downhole string;

a tool body circumscribing the tool stem and having a lower end selectively coupled with a casing hanger;

a cylindrical portion mounted on the stem above the body that is adapted to occupy the bore of the wellhead assembly; and a recessed portion displaced axially from the cylindrical portion that defines one end of a passage extending through the tool from a side facing the wellhead assembly to the bore of the wellhead assembly, wherein the recessed portion extends circumferentially around the tool, and wherein the passage comprises a radial passage coupled to the recessed portion and configured to face the wellhead assembly.

14. A method for establishing rotation of a component in a bore of a wellhead assembly, comprising:

securing a feedback member to a tool string adapted to support the component in the wellbore, wherein the feedback member comprises a first radial portion adapted to restrict fluid flow into the bore of the wellhead assembly from a fluid port in a sidewall of the wellhead assembly and a second radial portion adapted to restrict fluid flow into the bore of the wellhead assembly from the fluid port in the sidewall of the wellhead assembly less than the first radial portion; and establishing a number of rotations of the feedback tool based on a reduction in pressure in the fluid flow to the fluid port as the second radial portion is rotated to face the fluid port from the first radial portion.

* * * * *